United States Patent [19]

Toshimits et al.

[11] Patent Number: 4,892,076

[45] Date of Patent: Jan. 9, 1990

[54] FUEL SUPPLY CONTROL SYSTEM FOR INTERNAL COMBUSTION ENGINES

[75] Inventors: Kazushige Toshimits; Keiichi Osawa; Tadashi Umeda; Kunio Noguchi, all of Wako, Japan

[73] Assignee: Honda Giken Kogyo Kabushiki Kaisha, Tokyo, Japan

[21] Appl. No.: 242,330

[22] Filed: Sep. 8, 1988

[30] Foreign Application Priority Data

Sep. 8, 1987 [JP] Japan ..... 62-224807

[51] Int. Cl.[4] ..... F02D 41/00

[52] U.S. Cl. ..... 123/442; 123/336; 123/478; 123/491

[58] Field of Search ..... 123/442, 336, 478, 491, 123/492, 494

[56] References Cited

U.S. PATENT DOCUMENTS

| | | | |
|---|---|---|---|
| 4,378,000 | 3/1983 | Moriya et al. | 123/442 |
| 4,462,367 | 7/1984 | Tanabe et al. | 123/442 |
| 4,708,115 | 11/1987 | Yamato et al. | 123/478 |
| 4,718,383 | 1/1988 | Fujisawa | 123/442 |
| 4,768,486 | 9/1988 | Koike et al. | 123/442 |

FOREIGN PATENT DOCUMENTS 63-143346 6/1988 Japan .

*Primary Examiner*—Andrew M. Dolinar

*Attorney, Agent, or Firm*—Lyon & Lyon

[57] ABSTRACT

A fuel supply control system for an internal combustion engine having a throttle body, and a fuel injection valve arranged in an intake manifold upstream of the throttle body for supplying fuel to all cylinders. An air throttle valve has a valve body having a notched opening formed therein and disposed to be opposite the nozzle of the fuel injection valve to increase the flow speed of intake air in the vicinity of the nozzle when the air throttle valve is fully closed. An electronic control unit controls the fuel injection valve in response to operating conditions of the engine. The electronic control unit causes the air throttle valve to be fully closed when a predetermined low rotation-speed operating condition of the engine, in which at least the rotational speed of the engine is lower than a predetermined value, is satisfied. The predetermined value of the rotational speed of the engine is set such that the lower the atmospheric pressure the smaller the predetermined value.

19 Claims, 5 Drawing Sheets

FUEL SUPPLY CONTROL SYSTEM FOR INTERNAL COMBUSTION ENGINES

BACKGROUND OF THE INVENTION

The present invention relates to a fuel supply control system for an internal combustion engine which is of the type having a fuel injection valve arranged in an intake manifold at a location upstream of a throttle valve for supplying fuel to all the cylinders and, more particularly, to a fuel supply control system of this kind which corrects an amount of fuel supplied to the engine, depending upon atmospheric pressure.

Conventionally, a fuel supply device for an internal combustion engine has been proposed, e.g., by U.S. Pat. No. 4,378,000, which engine has a fuel injection valve arranged in an intake manifold at a location upstream of a throttle valve for commonly supplying fuel to a plurality of cylinders thereof, thereby reducing the number of fuel injection valves employed and hence reducing the manufacturing cost of the fuel supply device. According to the proposed control device, an air throttle valve is arranged such that a notched opening formed therein is disposed opposite the nozzle of the fuel injection valve when it is closed, so as to increase the flow speed of intake air in the vicinity of the nozzle.

Further, a method has been proposed by Japanese Provisional Patent Publication (Kokai) No. 63-143346 by the present assignee, which controls an air throttle valve as mentioned above to assume its closed position when a predetermined low rotational-speed condition of the engine is satisfied, thereby improving the atomizing behavior of fuel injected into the intake manifold and and hence achieving stable driveability of the engine at low rotational-speed operation of same.

However, in the proposed method, a predetermined engine rotational speed for determining whether the predetermined low rotational-speed operating condition of the engine is satisfied or not is set at a fixed value and accordingly the timing, at which the air throttle valve is brought into its closed position with respect to the rotational speed of the engine, is not varied regardless of whether at high altitude or at low altitude the engine is operating. Therefore, when the engine is operating at high altitude where air has low density, the mass of intake air substantially decreases accordingly. As a result, the amount of intake air supplied to the engine becomes insufficient at acceleration of the engine immediately following engine operation under the predetermined low rotational-speed operating condition, whereby the engine cannot produce required output and hence has degraded driveability.

SUMMARY OF THE INVENTION

It is the object of the invention to provide a fuel supply control system for an internal combustion engine, which is capable of ensuring required engine output at acceleration of the engine regardless of atmospheric pressure, that is, at both high and low altitudes, thereby improving the driveability of the engine.

To attain the above object, the present invention provides a fuel supply control system for an internal combustion engine having a plurality of cylinders, an intake manifold formed by a diversified portion connected to each of the cylinders and a united portion to which the diversified portion is joined, a throttle body arranged within the united portion of the intake manifold, and a throttle valve provided within the throttle body.

The fuel supply control system is characterized by comprising: a fuel injection valve arranged in the united portion of the intake manifold at a location upstream of the throttle body and having a nozzle for supplying fuel to the cylinders; an air throttle valve arranged in the united portion of the intake manifold at a location upstream of the throttle body, the air throttle valve having a valve body having a notched opening formed therein and disposed to be opposite the nozzle of the fuel injection valve to increase the flow speed of intake air in the vicinity of the nozzle when the air throttle valve is fully closed; first valve control means for controlling the fuel injection valve in response to operating conditions of the engine; second valve control means for causing the air throttle valve to be fully closed when a predetermined low rotational-speed operating condition of the engine, in which at least the rotational speed of the engine is lower than a predetermined value, is satisfied; and means for setting the predetermined value of the rotational speed of the engine such that the lower the atmospheric pressure the smaller the predetermined value.

Preferably, the predetermined low rotational-speed operating condition may be satisfied when the rotational speed of the engine is lower than the predetermined value and a temperature of the engine is lower than a predetermined value.

More preferably, the second valve control means may keep the air throttle valve fully closed for a predetermined time period after the low rotational-speed operating condition has ceased to be satisfied.

Preferably, the fuel supply control system may include fuel supply increasing means for increasing the amount of fuel supplied to the engine through the fuel injection valve when a predetermined medium/high load condition, in which a load on the engine is equal to or higher than a predetermined value, is satisfied when the predetermined low rotational-speed operating condition is not satisfied.

Preferably, the fuel supply increasing means may effect a fuel supply increasing operation a number of times depending upon a temperature of the engine.

Preferably, the fuel supply increasing means may increase the amount of fuel by the use of a fuel supply increment depending upon a temperature of the engine.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
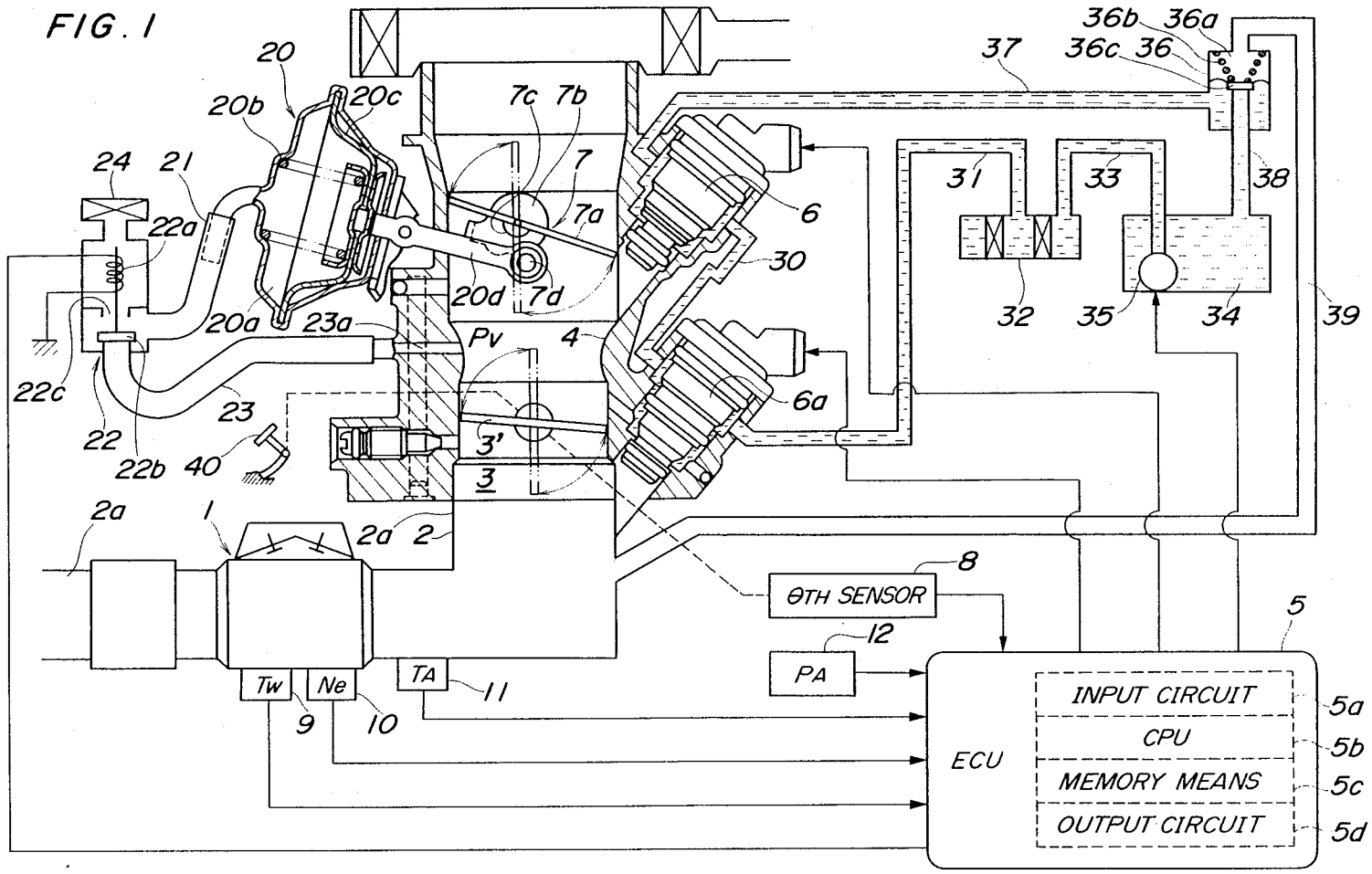
FIG. 1 is a block diagram of the whole arrangement of a fuel supply control system according to an embodiment of the invention, essential parts thereof being illustrated in detail.

Referring first to FIG. 1, there is illustrated the whole arrangement of a fuel supply control system for an internal combustion engine, to which the method according to the invention is applied. In the figure, reference numeral 1 designates an internal combustion engine which may be a four-cylinder type, for instance An intake manifold 2 is connected to the engine 1, which is formed by a diversified portion 2*a* having diverse pipes connected to respective cylinders and a united portion 2*b* to which the diverse pipes are joined. In the united portion 2*b* of the intake manifold 2 is arranged a throttle body 3 internally provided with a throttle valve 3' which has its opening $\theta_{TH}$ varied in accordance with a change in the position of an accelerator pedal 40 of a vehicle in which the engine is installed. A throttle valve opening sensor (hereinafter called "the $\theta_{TH}$ sensor") 8 is connected to the throttle valve 3' to supply an electrical signal indicative of the openin $\theta_{TH}$ of the throttle valve 3' to an electronic control unit (hereinafter referred to as "the ECU") 5.

Figure 2:
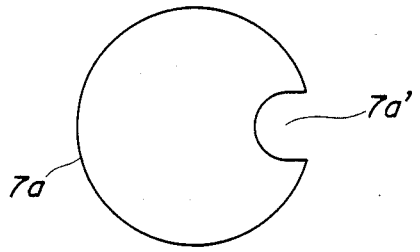
FIG. 2 is a plan view of the valve body of an air throttle valve in FIG. 1.

A fuel injection valve 6 and an air throttle valve 7 are provided in the united portion 2*b* of the intake manifold 2 at a location slightly upstream of the throttle valve 3'. The fuel injection valve 6 supplies fuel to all the cylinders of the engine 1 while the engine 1 is operating in an operating mode other than an idling mode. The air throttle valve 7 regulates the flow speed of intake air in the vicinity of the nozzle of the fuel injection valve 6 within the intake manifold 2. As shown in FIG. 2, the air throttle valve 7 has a valve body 7*a* in the form of a disk formed at a peripheral edge thereof with a notched opening 7*a*' serving as a throttle opening. When the valve body 7*a* is closed as indicated by the solid lines in FIG. 1, the area of the air flow passage upstream of the throttle valve 3' within the throttle body 3 is reduced to the minimum value corresponding to the area of the notched opening 7*a*', and the notched opening 7*a*' is positioned opposite the nozzle of the fuel injection valve 6.

The air throttle valve 7 is a pressure-operated valve incorporating a diaphragm actuator 20. The negative pressure chamber 20*a* of the diaphragm actuator 20 is communicated with a port 23*a* opening into a Venturi section 4 formed in the throttle body 3 upstream of the throttle valve 3', by means of a conduit 21, a pressure changeover valve 22 and a conduit 23. A diaphragm 20*c* defining the negative pressure chamber 20*a* is biased by a spring 20*b*. A rod 20*d* has one end pivotally joined to a valve holder 7*b* of the air throttle valve 7 via a fulcrum shaft 7*d* and the other end connected to the diaphragm 20*c*. The valve holder 7*b* is pivotally mounted on a fixed shaft 7*c*. The valve element 7*a* is fixed to the valve holder with the latter. As the negative pressure Pv in the Venturi section 4 increases, the diaphragm 20*c* moves against the resilient force of the spring 20*b* to turn the valve element 7*a* of the air throttle valve 7 clockwise as viewed in FIG. 1 toward a position indicated by the two-dot chain lines in FIG. 1 through the rod 20*d*, the fulcrum shaft 7*d*, and the valve holder 7*b*. Thus, the valve element 7*a* of the air throttle valve 7 approaches the closed position (the position indicated by the solid lines in FIG. 1) as the negative pressure Pv decreases, and approaches the open position (a position indicated by the two-dot chain lines in FIG. 1) as the negative pressure Pv increases.

The pressure changeover valve 22 has a solenoid 22*a*, and a valve element 22*b* which opens an opening 22*c* when the solenoid 22*a* is deenergized and opens an open end of the conduit 23 when the solenoid 22*a* is energized. Accordingly, when the solenoid 22*a* is energized, the negative pressure chamber 20*a* communicates with the Venturi section 4 through the open end of the conduit 23 and, when the solenoid 22*a* is deenergized, the open end of the conduit 23 is closed and the opening 22*c* is opened to communicate the negative pressure chamber 20*a* with the atmosphere through a filter 24. Thus, the valve body 7*a* of the air throttle valve 7 is held at the closed position irrespective of the magnitude of the negative pressure Pv in the Venturi section 4.

An auxiliary fuel injection valve 6*a* is provided in the intake manifold 2 at a location downstream of the throttle valve 3' within the united position 2*b*. The auxiliary fuel injection valve 6*a* supplies fuel to all the cylinders while the sufficiently warmed up engine 1 is idling. The auxiliary fuel injection valve 6*a* is connected to a fuel tank 34 through a conduit 31, a strainer 32 and a conduit 33. The fuel injection valve 6 and the auxiliary fuel injection valve 6*a* are interconnected by a conduit 30. A fuel pump 35 supplies fuel under pressure through the conduits 31, 33, and the strainer 32 to the auxiliary fuel injection valve 6*a* and also to the fuel injection valve 6 through the conduit 30. The fuel injection valve 6 is connected through return conduits 37 and 38 to the fuel tank 34. A pressure regulator 36 is interposed between the return conduits 37 and 38. The pressure regulator 36 has a negative pressure chamber 36*a* which communicates with the interior of the intake manifold 2 at a location downstream of the throttle valve 3' by means of a conduit 39. The pressure regulator 36 has a valve body 36*c* biased toward its valve seat by a spring 36*b*. Accordingly, the valve opening pressure of the valve body 36*c* of the pressure regulator 36 is determined by the balance of the resilient force of the spring 36*b* and the negative pressure prevailing within the intake manifold 2 downstream of the throttle valve 3'. Thus, the fuel pressure within the conduits 30, 31, etc., is regulated by the pressure regulator 36 to a value higher by a fixed amount than the pressure within the intake manifold 2 downstream of the throttle valve 3'.

An intake air temperature sensor (hereinafter referred to as "the TA sensor") 11 for detecting the temperature of intake air within the united portion 2*b* of the intake manifold 2 is provided in the united portion 2*b*. The TA sensor 11 gives an electric signal representing the detected intake air temperature to the ECU 5.

An engine coolant temperature sensor (hereinafter referred to as "the $T_W$ sensor") 9, which may be formed of a thermistor or the like, is mounted in the cylinder block of the engine 1 in a manner embedded in the peripheral wall of an engine cylinder having its interior filled with coolant, detects engine coolant temperature $T_W$, and supplies an electrical signal indicative of the detected engine coolant temperature to the ECU 5. An engine rotational speed sensor (hereinafter referred to as "the Ne sensor") 11 is arranged in facing relation to a camshaft, not shown, of the engine 1 or a crankshaft of same, not shown. The Ne sensor is adapted to generate a pulse of a top-dead-center position (TDC) signal (hereinafter referred to as "the TDC signal") at one of partiuular crank angles of the engine, i.e., at a crank angle position of each cylinder which comes a predetermined crank angle earlier relative to the top-dead-center position (TDC) at which the suction stroke thereof starts, whenever the engine crankshaft rotates through 180 degrees. The pulse generated by the Ne sensor is supplied to the ECU 5.

Further connected to the ECU 5 are an atmospheric pressure sensor (hereinafter referred to as "the $P_A$ sensor") 15 for detecting atmospheric pressure for supplying an electrical signal indicative of the detected atmospheric pressure to the ECU 5.

The ECU 5 comprises an input circuit 5a which shapes the respective waveforms of input signals received from some of the sensors, adjusts the respective voltages of signals from other sensors to a predetermined level, and converts the respective analog values of the voltage-adjusted input signals to corresponding digital values, a central processing unit (hereinafter referred to as "the CPU") 5b, a memory unit 5c which stores programs to be executed by the CPU 5b and results of operations executed by the CPU 5b, and an output circuit 5d which gives driving signals to the pressure changeover valve 22, the fuel injection valve 6, and the auxiliary fuel injection valve 6a.

Figure 3:
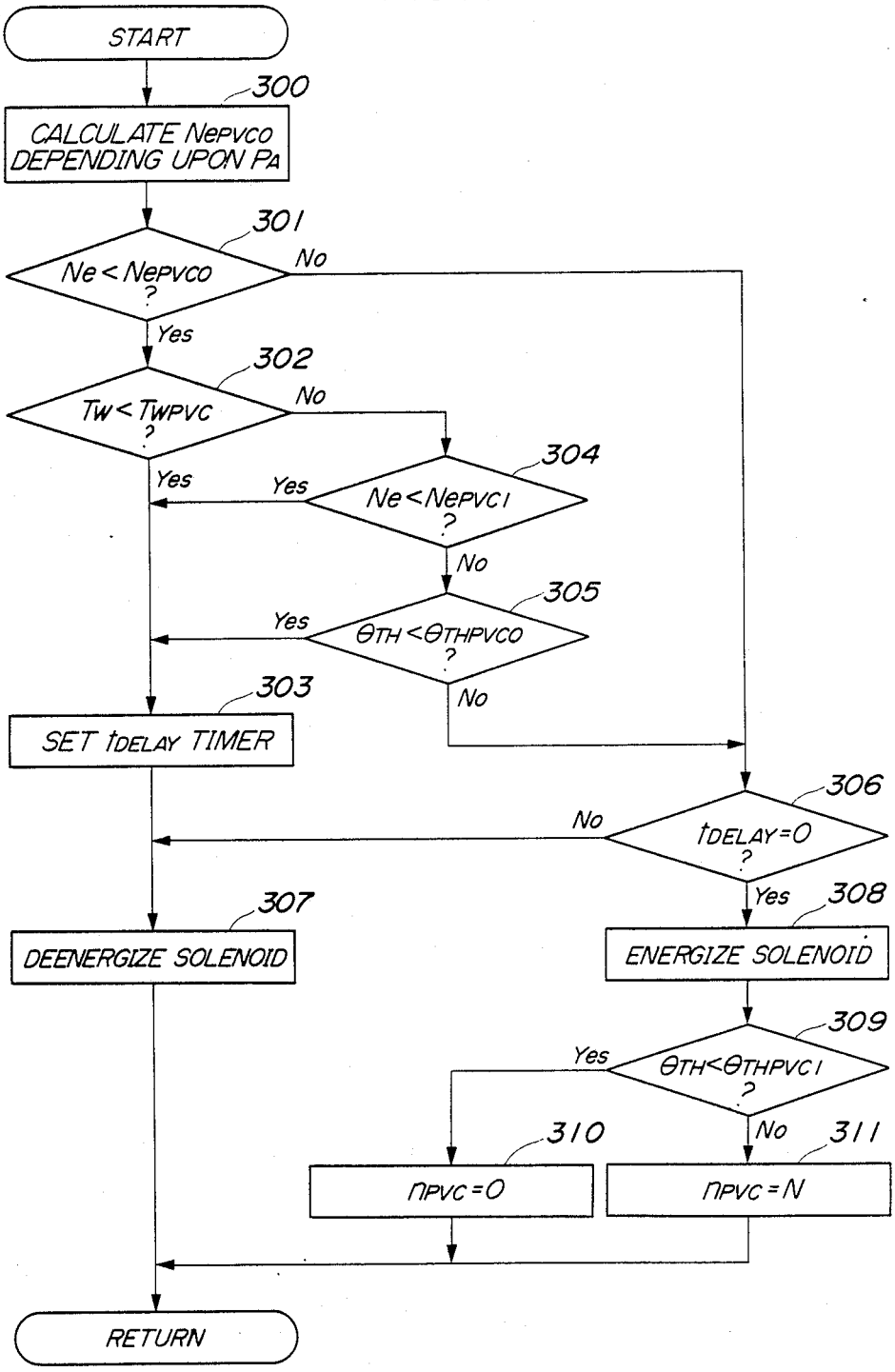
FIG. 3 is a flowchart of a control program for controlling the operation of a pressure changeover valve in FIG. 1.

The CPU 5b executes a control program for controlling the pressure changeover valve 22, as shown in FIG. 3, as well as one for controlling supply of fuel to the engine 1, not shown, in synchronism with generation of pulses of the TDC signal. The CPU 5b operates in response to various engine operating parameter signals supplied through the input circuit 5a, to energize and deenergize the solenoid 22a of the pressure changeover valve 22, and to calculate fuel injection periods for which the fuel injection valve 6 and the auxiliary fuel injection valve 6a should be opened, based on the control programs. The fuel injection period $T_{OUT}$ for the fuel injection valve 6 located upstream of the throttle valve 3' is calculated upon generation of each pulse of the TDC signal, by the use of the following equation (1).

$$T_{OUT}=T_i\times K_{TW}\times K_1+K_2 \quad (1)$$

where Ti represents a basic value of the valve opening period for the fuel injection valve 6, which is determined from the engine rotational speed Ne and the intake manifold absolute pressure $P_{BA}$, for example. $K_{TW}$ is an engine coolant temperature-dependent correction coefficient, which has its value determined by engine coolant temperature $T_W$.

$K_1$ and $K_2$ are other correction coefficients and correction variables, respectively, calculated on the basis of engine operating parameters.

The CPU 5b further calculates a fuel injection period $T_{MA}$ for which the fuel injection valve 6 should be opened in order to increase the supply amount of fuel during acceleration of the engine 1, asynchronously with generation of pulses of the TDC signal, by the use of the following equation (2).

$$T_{MA}=T_{OUTA0}+T_{OUTP1}+T_{VM} \quad (2)$$

where $T_{OUTA0}$ represents a basic acceleration fuel increment, which is determined from the valve opening speed of the throttle valve 3'. $T_{OUTA1}$ represents an acceleration fuel increment which is applied when the air throttle valve 7 is brought into an open state from a closed state. $T_{VM}$ is a correction value dependent on the output voltage of the battery.

Incidentally, the CPU 5b carries out control of fuel supply through the auxiliary fuel injection valve 6a downstream of the throttle valve 3', during the aforementioned idling operation of the fully warmed-up engine 1, description thereof being omitted.

FIG. 3 shows a control program for controlling the pressure changeover valve 22 to operate the air throttle valve 7, which is executed by the CPU 5b in synchronism with generation of TDC signal pulses.

Figure 4:
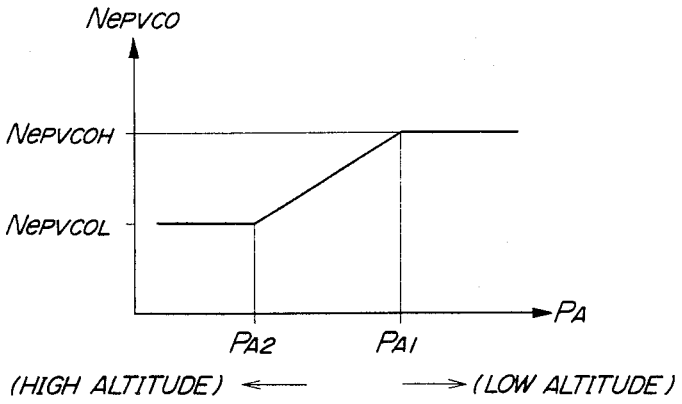
FIG. 4 is a graph showing a table of the relationship between a first predetermined engine rotational-speed $Ne_{PVCO}$ for determining fulfillment of a low rotational-speed operating condition of the engine, which is applied to the control program of FIG. 3, and atmospheric pressure.

First, at a step 300, a first predetermined value $Ne_{PVCO}$ of the engine rotational speed Ne, which is to be applied to a determination at the next step 301, is determined based upon atmospheric pressure $P_A$. FIG. 4 shows an $Ne_{PVCO}$ table for setting the first predetermined value $Ne_{PVCO}$. Specifically, in the figure, the first predetermined value $Ne_{PVCO}$ is set to a first value $Ne_{PVCOH}$ (e.g., 2,800 rpm) when atmospheric pressure $P_A$ is equal to or higher than a first predetermined value $P_{A1}$ (e.g., 750 mmHg), while it is set to a second value $Ne_{PVCOL}$ (e.g which is lower than the first value $Ne_{PVCOH}$ when atmospheric pressure $P_A$ is lower than a second predetermined value $P_{A2}$ (e.g., 500 mmHg), i.e., $P_{A2}<P_{A1}$. When atmospheric pressure falls between the first and second predetermined values $P_{A1}$ and $P_{A2}$, the first value $Ne_{PVCO}$ is set so as to vary linear atmospheric pressure varies.

Then, at the step 301, it is determined whether or not the engine rotational speed Ne is lower than the first predetermined value $Ne_{PVCO}$ set at the step 300. If the answer to the question is affirmative or Yes, that is, if $Ne<Ne_{PVCO}$ is satisfied, the program proceeds to a step 302, wherein it is determined whether the engine coolant temperature $T_W$ is lower than a predetermined value $T_{WPVC}$ (e.g., 60° C.) or not. If the answer to the question of the step 302 is affirmative or Yes, that is, if $Ne<Ne_{PVCO}$ and $T_W<T_{WPVC}$ are both satisfied, which means that the engine 1 is not operating at a high rotational speed and at the same time the engine coolant temperature is low, the program proceeds to a step 303, wherein a $t_{DELAY}$ timer is set to a predetermined time period $t_{DELAY}$ (e.g., 0.3 seconds), and then the program proceeds to a step 307, wherein the solenoid 22a of the pressure changeover valve 22 is deenergized so that the negative pressure chamber 20a of the diaphragm actuator 20 communicates with the atmosphere for introducing atmospheric pressure thereinto to close the air throttle valve 7, followed by terminating the program.

As described above, when $Ne<Ne_{PVCO}$ and $T_W<T_{WPVC}$ are both satisfied, the air throttle valve 7 is closed, and the first predetermined value $Ne_{PVCO}$ is set, at the step 300, such that the lower atmospheric pressure $P_A$ the smaller the first predetermined value $Ne_{PVCO}$. Consequently, when the engine 1 is operated at a high altitude, an engine rotational speed region in which the air throttle valve 7 is forcibly closed becomes narrow and hence the air throttle valve 7 is opened at a lower engine rotational speed so that the intake air amount is increased at earlier timing, thereby preventing insufficient supply of intake air and hence obtaining desired engine output at the succeeding acceleration of the engine 1.

Incidentally, even when the air throttle valve 7 is in the closed state if the amount of intake air is large such as in a high-load operation of the engine 1, the air throttle valve 7 is somewhat opened by the dynamic pressure of the intake air.

If the answer to the question of the step 302 is negative or No, that is, if $T_W < T_{WPVC}$ is satisfied, the program proceeds to a step 304, wherein it is determined whether or not the engine rotational speed Ne is lower than the second predetermined value $Ne_{PVC1}$ (e.g., 1,200 rpm), which is lower than the first predetermined value $Ne_{PVC0}$. If the answer to the question of the step 304 is affirmative or Yes, that is, if $T_W < T_{WPVC}$ and $Ne < Ne_{PVC1}$ are both satisfied, i.e., when the engine coolant temperature is not low, but the engine 1 is operating at a low rotational speed, the aforementioned steps 303 and 307 are executed to close the air throttle valve 7, followed by terminating the program.

If the answer to the question of the step 304 is negative or No, that is, if $Ne < Ne_{PVC1}$ is satisfied, the program proceeds to a step 305, wherein it is determined whether or not the opening $\theta_{TH}$ of the throttle valve 3' is smaller than a predetermined value $\theta_{THPVC}$ (e.g., 20 degrees). If the answer to the question of the step 305 is affirmative or Yes, that is, if $Ne_{PVC1} < Ne < Ne_{PVC0}$, $T_W \geqq T_{WPVC}$, and $\theta_{THPVC}$ all satisfied, i.e., when the engine 1 is operating at a medium rotational speed, and the engine coolant temperature is not low, but the opening of the throttle valve 3' is small, the aforementioned steps 303 and 307 are executed to close the air throttle valve 7, followed by terminating the program.

If the answer to the question of the step 305 is negative or No, that is, $Ne_{PVC1} \geqq Ne <$ Nehd PVC0, $T_W \geqq T_{WPVC}$, and $\theta_{TH} \geqq \theta_{THPVC}$ are all satisfied, i.e., when the engine 1 is operating at a medium rotational speed, the engine coolant temperature is not low, and the opening of the throttle valve 3' is not small, the program proceeds to a step 306, wherein it is determined whether the counted value of the $t_{DELAY}$ timer is equal to zero or not. If the answer to the question of the step 306 is negative or No, that is, if the time period $t_{DELAY}$ has not elapsed after setting thereof, the step 307 is executed to maintain the air throttle valve 7 closed, followed by terminating the program.

If the answer to the question of the step 306 is affirmative or Yes, that is, if the predetermined time period $t_{DELAY}$ has elapsed, the program proceeds to a step 308, wherein the solenoid 22a of the pressure changeover valve 22 is energized to communicate the negative pressure chamber 20a of the diaphragm actuator 20 with the Venturi section 4 to permit the air throttle valve 7 to be opened and closed directly in response to the negative pressure $P_V$ within the Venturi section 4, and thereafter the program proceeds to a step 309, hereinafter described.

The reason for providing the given waiting time period $t_{DELAY}$ for cancelling the valve-closing control for the air throttle valve 7 is that when a condition of opening the valve 7 is instantaneously satisfied, the air throttle valve 7 is prevented from being opened to be positively maintained in its closed state. On the other hand, when the engine 1 is accelerated so that the flow rate of intake air becomes high, the air throttle valve 7 is opened such that the higher the load on the engine 1 the lower the rate in change of the intake air flow rate to thereby prevent shocking due to abrupt change in the flow rate of intake air.

If the answer to the question of the aforementioned step 301 is negative or No, that is, if $Ne \geqq Ne_{PVCO}$ is satisfied, the engine 1 is operating at a high rotational speed, and accordingly the program jumps to the step 306, followed by executing the step 307 or 308 et seq. depending upon the determination at the step 306.

At a step 309, it is determined whether the opening $\theta_{TH}$ of the throttle valve 3' is smaller than a predetermined value $\theta_{PVC1}$ (e.g., 10 degrees) or not. If the answer is affirmative or Yes, a flag $n_{PVC}$ representing the number of times of asynchronous fuel supply increasing operation to be executed, which is to be applied to a determination at a step 401 in FIG. 5, hereinafter described, is set to 0 at a step 310, whereas if the answer is negative or No, the flag $n_{PVC}$ is set to a predetermined value N at a step 311, followed by terminating the program.

Figure 6:
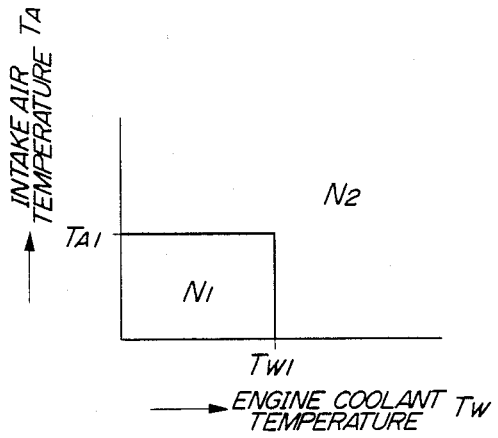
FIG. 6 is a graph showing a table for setting a predetermined value N, i.e., a predetermined number of times of asynchronous fuel supply increasing operations.

As described later, when the flag $n_{PVC}$ is set to the predetermined value N, the asynchronous fuel supply increasing operation is repeated N times. FIG. 6 shows, by way of example, an N Table for setting the predetermined value N, wherein the predetermined value N is set in accordance with the engine coolant temperature $T_W$ and the intake air temperature $T_A$ which is detected at the start of the engine 1. To be specific, the predetermined value N is set to a first predetermined value $N_1$ (e.g., 10) when the engine coolant temperature $T_W$ is lower than a predetermined value $T_{W1}$ (e.g., 70° C.) and at the same time the intake air temperature $T_A$ detected at the start of the engine 1 is lower than a predetermined value $T_{A1}$ (e.g., 18° C.). On the other hand, the predetermined value N is set to a second predetermined value $N_2$ (e.g., 6), which is smaller than the first predetermined value $N_1$, when the engine coolant temperature $T_W$ is equal to or higher than the predetermined value $T_{W1}$, or the intake air temperature $T_A$ is equal to or higher than the predetermined value $T_{A1}$. By setting the predetermined value N as described above, the mixture of fuel supplied to each cylinder can be prevented from being leaned when the engine is in a cold state in cold weather, because when the engine coolant temperature $T_W$ and the intake air temperature $T_A$ are both low, the degree of atomization of fuel is low and hence fuel is apt to adhere to the throttle valve 3', etc.

Further, the reason for using the intake air temperature $T_A$ detected at the start of the engine 1 is that the intake air temperature $T_A$ varies in such a manner that when the engine 1 is restarted shortly after stoppage of the engine 1, the intake air temperature $T_A$ within the united portion 2a, in which the $T_A$ sensor 11 is mounted, is relatively high at the restart of the engine 1, then once lowers due to latent heat of vaporing fuel and thereafter rises again. Therefore, the intake air temperature $T_A$ detected at the start of the engine 1 reflects more properly the atomizing characteristic of fuel than the air temperature $T_A$ subsequently detected during operation of the engine 1 after starting. However, if the $T_A$ sensor 11 is arranged at such a location that it is not affected by the latent heat of vaporing fuel, e.g., at a location within the united portion 2a, the intake air temperature $T_A$ detected during operation of the engine after starting may be employed as a parameter for setting the predetermined value N.

The reason for setting the flag $n_{PVC}$ to 0 at the step 310 when the opening $\theta_{Th}$ of the throttle valve 3' is smaller than the predetermined value $\theta_{THPVC1}$ is that at such a small throttle valve opening the mixture of fuel supplied to each cylinder will not be so leaned that no asynchronous fuel supply increasing operation is necessary, even when the air throttle valve 7 is opened.

Figure 5:
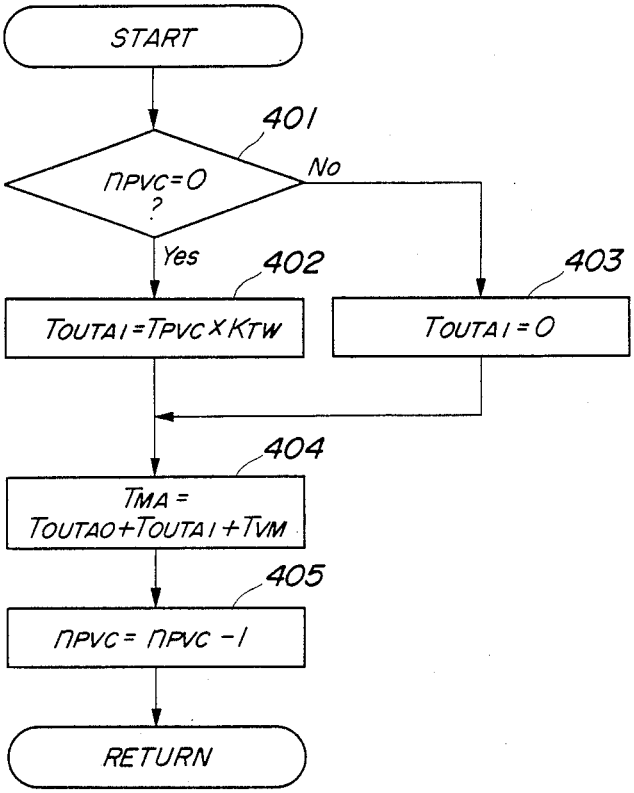
FIG. 5 is a flowchart of a control program for effecting an asynchronous fuel supply increasing operation.

FIG. 5 shows a control program for effecting the asynchronous fuel supply increasing operation, which is executed asynchronously with generation of TDC signal pulses, that is, is executed at a given time interval t (e.g., 10 milliseconds) counted by a timer by interrupting the control program of FIG. 3.

First, at a step 401, it is determined whether or not the flag $n_{PVC}$ representing the number of times of asynchronous fuel supply increasing operation is larger than 0. If the answer is affirmative or Yes, a value of the accelerating fuel increment $T_{OUTA1}$ applied during opening of the air throttle valve 7 is calculated at a step 402 by the use of the following equation (3).

$$T_{OUTA1} = T_{PVC} \times K_{TW} \quad (3)$$

where $T_{PVC}$ is a value dependent on the fuel injection rate characteristic of the fuel injection valve 6, engine coolant temperature $T_W$, and intake air temperature $T_A$, and $K_{TW}$ is a temperature-dependent correction coefficient dependent on the engine coolant temperature $T_W$, which is the same as the temperature-dependent correction coefficient $T_W$ in the equation (1).

Figure 7:
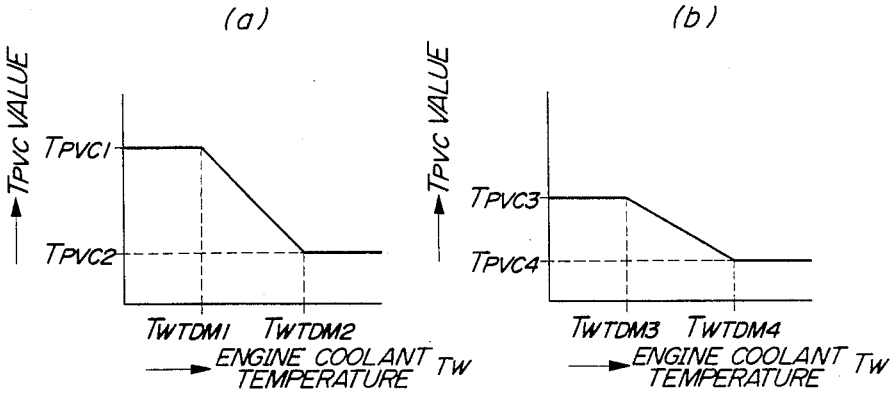
FIGS. 7 (*a*) and (*b*) are graphs a $T_{PVC}$-engine coolant temperature table for respective lower and higher intake air temperatures, which is applied for calculating an accelerating fuel increment $T_{OUTAI}$ when the air throttle valve is opened.

FIG. 7 shows, by way of example, a $T_{PVC}$ Table for setting the $T_{PVC}$ value, which consists of two tables, i.e., a table shown in (a) of FIG. 7 and a table shown in (b) of FIG. 7, which are selected depending upon the intake air temperature TA detected at the start of the engine 1. Specifically, the table for lower intake air temperature, shown in (a) of FIG. 7, is selected when the intake air temperature $T_A$ detected at the start of the engine 1 is lower than a predetermined value $T_{ATDM}$ (e.g , 18° C.), wherein the $T_{PVC}$ value is set to a first predetermined value $T_{PVC1}$ (e.g., 2.0 milliseconds) when the engine coolant temperature $T_W$ is equal to or lower than a first predetermined value $T_{WTDM1}$ (e.g., 60° C.), while it is set to a second predetermined value $T_{PVC2}$ (e.g., 1.0 millisecond), which is smaller than the first predetermined value $T_{PVC1}$, when the engine coolant temperature $T_W$ is equal to or higher than a second predetermined value $T_{WTDM2}$ (e.g., 80° C.). When the engine coolant temperature $T_W$ falls between the first and second predetermined values $T_{PCV1}$ and $T_{PCV2}$, the $T_{PVC}$ value is set so as to vary linearly as the temperature $T_W$ varies.

On the other hand, the table for higher intake air temperature, shown in (b) of FIG. 7, is selected when the intake air temperature $T_A$ detected at the start of the engine 1 is equal to or higher than the predetermined value $T_{ATDM}$ (e.g., 18° C.), wherein the $T_{PVC}$ value is generally set to smaller values tha corresponding values in the aforementioned table. The $T_{PVC}$ value is set to a third predetermined value $T_{PVC3}$ (e.g., 2.0 milliseconds) when the engine coolant temperature $T_W$ is equal to or lower than a third predetermined value $T_{WTDM3}$ (e.g., 55° C.), while it is set to a fourth predetermined value $T_{PVC4}$ (e.g., 0.9 milliseconds), which is smaller than the third predetermined value $T_{PVC3}$, when the engine coolant temperature $T_W$ is equal to or higher than a fourth predetermined value $T_{WTDM2}$ (e.g., 80° C.). When the engine coolant temperature $T_W$ falls between the third and fourth predetermined values $T_{PCV3}$ and $T_{PCV4}$, the $T_{PVC}$ value is set so as to vary linearly as the temperature $T_W$ varies.

As described above, the $T_{PCV}$ value is set to larger values as the intake air temperature $T_A$ detected at the start of the engine 1 is higher and as the engine coolant temperature $T_W$ is higher. As the $T_{PCV}$ value is thus set to larger values, the acceleration fuel increment $T_{OUTA1}$ applied during opening of the air throttle valve 7 is set to correspondingly larger values by the equation (3).

Further, the reason for using the intake air temperature $T_A$ detected at the start of the engine for setting the $T_{PCV}$ value is similar to the reason previously stated with respect to setting of the predetermined number of times N.

On the other hand, if the answer to the question of the step 401 is negative or No, accelerating fuel increment $T_{OUTA1}$ during opening of the air restriction valve 7 is set to 0 at a step 403.

After execution of the steps 402 and 403, the fuel injection period $T_{MA}$ of the fuel injection valve 6 is calculated based upon the $T_{OUTA1}$ value thus determined, by the use of the equation (2) at a step 404, and the flag $n_{PVC}$ value is subtracted by 1 at a step 405, followed by terminating the program.

What is claimed is:

1. A fuel supply control system for an internal combustion engine having a plurality of cylinders, an intake manifold formed by a diversified portion connected to each of said cylinders and a united portion to which said diversified portion is joined, a throttle body arranged within said united portion of said intake manifold, and a throttle valve provided within said throttle body said fuel supply control system comprising: a fuel injection valve arranged in said united portion of said intake manifold at a location upstream of said throttle body and having a nozzle for supplying fuel to said cylinders; an air throttle valve arranged in said united portion of said intake manifold at a location upstream of said throttle body, said air throttle valve having a valve body having a notched opening formed therein and disposed to be opposite said nozzle of said fuel injection valve to increase the flow speed of intake air in the vicinity of said nozzle when said air throttle valve is fully closed; first valve control means for controlling said fuel injection valve in response to operating conditions of said engine; second valve control mean for causing said air throttle valve to be fully closed when a predetermined low rotational-speed operating condition of said engine, in which at least the rotational speed of said engine is lower than a predetermined value, is satisfied; and means for setting said predetermined value of the rotational speed of said engine such that the lower the atmospheric pressure the smaller said predetermined value.

2. A fuel supply control system as claimed in claim 1, wherein said predetermined low rotational-speed operating condition is satisfied when the rotational speed of said engine is lower than said predetermined value and a temperature of said engine is lower than a predetermined value.

3. A fuel supply control system as claimed in claim 2, wherein said second valve control means causes said air throttle valve to be fully closed when the rotational speed of said engine is lower than a second predetermined value, which is lower than said first-mentioned predetermined value, even if said temperature of said engine is equal to or higher than said predetermined value.

4. A fuel supply control system as claimed in claim 2 or claim 3, wherein said second valve control means causes said air throttle valve to be fully closed when the opening of said throttle valve is smaller than a predetermined value even if said temperature of said engine is equal to or higher than said predetermined value.

5. A fuel supply control system as claimed in claim 2 or claim 3, wherein said temperature of said engine is engine coolant temperature.

6. A fuel supply control system as claimed in any of claims 1–3, wherein said second valve control means keeps said air throttle valve fully closed for a predetermined time period after said low rotational-speed operating condition has ceased to be satisfied.

7. A fuel supply control system as claimed in claim 1, including fuel supply increasing means for increasing the amount of fuel supplied to said engine through said fuel injection valve when a predetermined medium/-high load condition, in which a load on said engine is equal to or higher than a predetermined value, is satisfied when said predetermined low rotational-speed operating condition is not satisfied.

8. A fuel supply control system as claimed in claim 7, wherein said fuel supply increasing means effects a fuel supply increasing operation a number of times depending upon a temperature of said engine.

9. A fuel supply control system as claimed in claim 8, wherein said number of times is set such that the lower said temperature of said engine the more said number of times.

10. A fuel supply control system as claimed in claim 8, wherein said temperature of said engine is at least one of engine coolant temperature and intake air temperature.

11. A fuel supply control system as claimed in claim 10, wherein said intake air temperature is detected at the start of said engine.

12. A fuel supply control system as claimed in any of claims 7–11, wherein said medium/high load condition is satisfied when the opening of said throttle valve is larger than a predetermined value.

13. A fuel supply control system as claimed in claim 7, wherein said fuel supply increasing means increases the amount of fuel by the use of a fuel supply increment depending upon a temperature of said engine.

14. A fuel supply control system as claimed in claim 13, wherein said fuel supply increment is set such that the lower said temperature of said engine the larger said fuel supply increment.

15. A fuel supply control system as claimed in claim 13, wherein said temperature of said engine is at least one of engine coolant temperature and intake air temperature.

16. A fuel supply control system as claimed in claim 10, wherein said intake air temperature is detected at the start of said engine.

17. A fuel supply control system as claimed in any of claims 13–16, wherein said fuel supply increment is the product of a first coefficient dependent upon engine coolant temperature and intake air temperature, and a second coefficient dependent upon said engine coolant temperature.

18. A fuel supply control system as claimed in claim 1, wherein said second valve control means operates in synchronism with generation of pulses of a signal at a predetermined crank angle of each of said cylinders.

19. A fuel supply control system as claimed in claim 7, wherein said fuel supply increasing means operates at fixed time intervals.

* * * * *